US009650909B2

(12) United States Patent
Smith

(10) Patent No.: US 9,650,909 B2
(45) Date of Patent: May 16, 2017

(54) MULTI-STAGE COMPRESSOR FAULT DETECTION AND PROTECTION

(75) Inventor: Raub Warfield Smith, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 2761 days.

(21) Appl. No.: 12/437,387

(22) Filed: May 7, 2009

(65) Prior Publication Data

US 2010/0281843 A1 Nov. 11, 2010

(51) Int. Cl.

| | |
|---|---|
| ***F01D 17/08*** | (2006.01) |
| ***F01D 21/00*** | (2006.01) |
| ***F04D 17/12*** | (2006.01) |
| ***F04D 27/00*** | (2006.01) |
| *F02B 39/16* | (2006.01) |

(52) U.S. Cl.

CPC ..... *F01D 17/08* (2013.01); *F01D 21/003* (2013.01); *F04D 17/12* (2013.01); *F04D 27/001* (2013.01); *F02B 39/16* (2013.01); *F05D 2260/80* (2013.01); *F05D 2270/10* (2013.01)

(58) Field of Classification Search

CPC .... F01D 17/08; F01D 21/003; F05D 2260/10; F05D 2270/10

USPC ..... 60/39.091, 39.24, 239, 805; 415/17

See application file for complete search history.

(56) References Cited

U.S. PATENT DOCUMENTS

| | | | | |
|---|---|---|---|---|
| 5,594,665 | A | 1/1997 | Walter et al. | |
| 5,782,603 | A * | 7/1998 | O'Brien et al. | 415/1 |
| 6,231,306 | B1 * | 5/2001 | Khalid | 416/26 |
| 6,506,010 | B1 * | 1/2003 | Yeung et al. | 415/1 |
| 6,532,433 | B2 | 3/2003 | Bharadwaj et al. | |
| 6,823,675 | B2 | 11/2004 | Brunell et al. | |
| 7,409,854 | B2 | 8/2008 | Teolis et al. | |

FOREIGN PATENT DOCUMENTS

| | | | |
|---|---|---|---|
| CN | 101368515 | A | 2/2009 |
| EP | 0654162 | B1 | 6/1999 |
| JP | 06313734 | A2 | 11/1994 |
| JP | 11022693 | A2 | 1/1999 |

OTHER PUBLICATIONS

Chinese Office Action for CN Application No. 201010176852.8 mailed Dec. 4, 2013, 6 pages.

Japanese Office Action for Application No. 2010-106071 mailed Feb. 18, 2014.

* cited by examiner

*Primary Examiner* — Arun Goyal

(74) *Attorney, Agent, or Firm* — Fletcher Yoder, P.C.

(57) ABSTRACT

In certain embodiments, a system includes a controller configured to obtain an inter-stage pressure measurement between stages of a multi-stage compressor. The controller is also configured to identify actual damage in the multi-stage compressor based at least in part on the inter-stage pressure measurement.

17 Claims, 6 Drawing Sheets

MULTI-STAGE COMPRESSOR FAULT DETECTION AND PROTECTION

BACKGROUND OF THE INVENTION

The subject matter disclosed herein relates to fault detection and protection of compressors.

Compressors are used in a variety of industries and systems to compress a gas, such as air. For example, gas turbine engines typically include a compressor to provide compressed air for combustion and cooling. As appreciated, the health of the compressor affects performance, efficiency, downtime, and overall availability of the machine. If compressor components (e.g., blades, seals, etc.) wear or break, then the compressor may not provide sufficient compression of the gas (e.g., air) to the target system (e.g., gas turbine engine). Furthermore, breakage of compressor components may cause damage to the target system (e.g., gas turbine engine), thereby leading to downtime and increased repair costs. This is particularly problematic for power plants, which rely on continuous operation of gas turbine engines. As a result, it is desirable to identify faults at an early stage to protect the compressor and downstream gas turbine engine components from damage. Unfortunately, existing systems are not particularly well suited for early detection of faults in compressors. This is particularly true with multi-stage compressors, such as those used in gas turbine engines in power plants. For example, existing systems do not monitor inter-stage regions of these multi-stage compressors.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes an inter-stage sensor configured to sense a parameter at an inter-stage location between a plurality of stages of rotary blades of a rotary machine. The system also includes a controller configured to identify a fault in the rotary machine based at least in part on the sensed inter-stage parameter.

In a second embodiment, a system includes a controller configured to obtain an inter-stage pressure measurement between stages of a multi-stage compressor. The controller is also configured to identify actual damage in the multi-stage compressor based at least in part on the inter-stage pressure measurement.

In a third embodiment, a system includes a turbine engine. The turbine engine includes a compressor, a combustor, and a turbine expander. The compressor includes a plurality of compressor stages. The system also includes a plurality of inter-stage sensors configured to measure a plurality of parameters at inter-stage locations within the turbine engine. The system further includes a controller configured to identify a breakage in one of the compressor stages based at least in part on the plurality of parameters. The controller is also configured to output an alert indicative of the breakage, or automatically adjust an operating parameter of the turbine engine in response to the breakage, or automatically shut down the turbine engine in response to the breakage, or a combination thereof.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
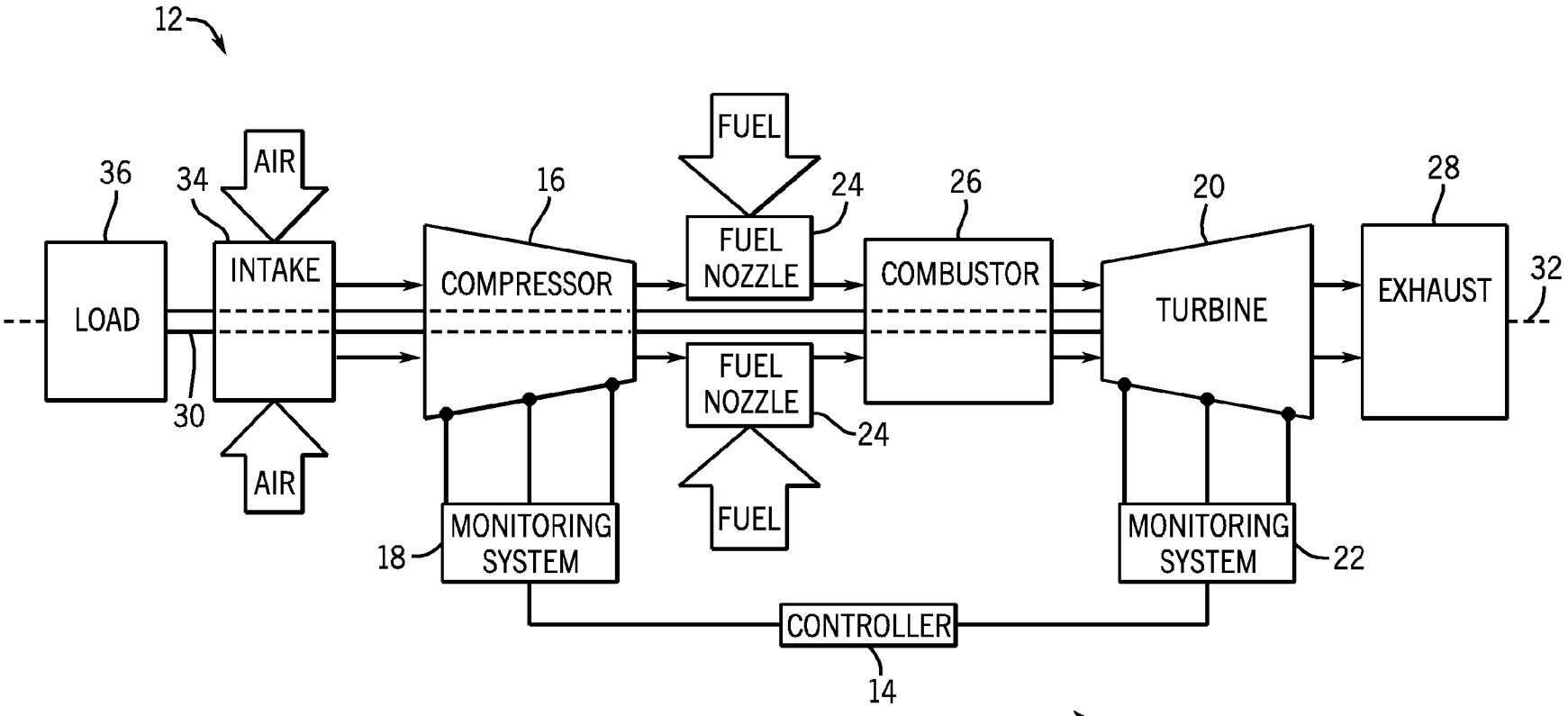
FIG. 1 is a block diagram of an exemplary embodiment of a gas turbine engine having a system to identify faults in a multi-stage compressor of the gas turbine engine.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment" or "an embodiment" of the present invention are not intended to be interpreted as excluding the existence of additional embodiments that also incorporate the recited features.

The disclosed embodiments include systems and methods for using inter-stage sensor measurements (e.g., pressure, temperature, acoustic, optical, and so forth) from a plurality of stages in a multi-stage rotary machine (e.g., compressors, turbines, and so forth) to identify faults within the multi-stage rotary machine. For simplicity, the multi-stage rotary machine disclosed herein will primarily be referred to as a multi-stage compressor. However, as appreciated, the systems and methods disclosed herein may also be utilized to identify faults in other types of rotary machines which include a plurality of stages.

During normal operation, each stage of the multi-stage compressor will generally increase the pressure and temperature of the working fluid by a certain amount. The amount of pressure and temperature increase at each stage of the multi-stage compressor may depend on particular operating conditions, such as speed, inlet boundary conditions (e.g., flow, pressure, temperature, composition, and so forth), outlet boundary conditions (e.g., flow resistance, and so forth), and stage efficiency. The overall pressure and temperature increase across the multi-stage compressor will generally be a summation of the pressure and temperature increases of the individual stages. Therefore, if one or more stages underperform, the state (e.g., pressure, temperature, and so forth) of the working fluid leaving the multi-stage compressor will be affected.

Ideally, the multi-stage compressor discharge measurements would be accurate enough to detect any deviation from expected or historical performance. However, since there may be hundreds or thousands of airfoils within the multi-stage compressor, a failure of one or a few of the individual airfoils may not change the overall performance of the multi-stage compressor significantly enough to rise above the level of measurement noise. Furthermore, the performance of the multi-stage compressor may vary considerably with operating conditions (e.g., guide vane position, inlet temperature and pressure, downstream resistance, and so forth) and may deteriorate over time (e.g., due to fouling, blade erosion, changes in clearance, and so forth), further complicating fault detection.

The disclosed embodiments address these difficulties by taking a different approach to multi-stage compressor fault detection. When a component is damaged or fails within the multi-stage compressor, the pressure and temperature distribution at each individual stage within the multi-stage compressor will also change. While the change in overall performance of the multi-stage compressor may not be readily detectable, the relative performance of each stage or group of stages may be more readily apparent and, thus, may provide a stronger indication of component damage or failure. The disclosed embodiments utilize sensor measurements (e.g., pressure, temperature, acoustic, optical, and so forth) at multiple locations within the multi-stage compressor (e.g., at least one inter-stage location in addition to the inlet and outlet of the multi-stage compressor). Deviations of these inter-stage sensor measurements from expected values may indicate that a fault has occurred in one of the stages. For simplicity, the inter-stage sensor measurements disclosed herein will primarily be referred to as pressure sensor measurements. However, as appreciated, the systems and methods disclosed herein may also include temperature sensor measurements, acoustic sensor measurements, optical sensor measurements, or any other type of sensor measurements which may indicate faults within multi-stage rotary machines, such as multi-stage compressors.

The increase in pressure between successive measurement locations may be compared to the overall increase in pressure across the multi-stage compressor, resulting in measured pressure increase ratios. These measured pressure increase ratios may be tracked as a function of any relevant set of operating conditions that would normally be expected to impact performance of the multi-stage compressor (e.g., shaft speed, guide vane position, inlet conditions, outlet conditions, and so forth). The measured pressure increase ratios may also be compared to expected pressure increase ratios as determined by modeling, measurement of other multi-stage compressors, or historical measurements of the same multi-stage compressor. If any of the measured pressure increase ratios deviate from the expected pressure increase ratios by more than a predetermined amount, an appropriate control response may be initiated, such as setting off an alarm, shutting down the multi-stage compressor, and so forth.

Alternatively, as described above, in certain embodiments, temperature measurements and temperature increase ratios may be used instead of or in conjunction with pressure measurements and pressure increase ratios. The choice between using pressure or temperature measurements may depend on measurement uncertainty and resultant fault detection sensitivity. In other words, if using pressure increase ratios for a particular multi-stage compressor leads to more reliable fault detection, the pressure increase ratios may be preferred over temperature increase ratios, and vice versa. In addition, in certain embodiments, comparison of both pressure and temperature increases for each multi-stage compressor section compared to other such sections may be beneficial instead of, or in addition to, comparison to the overall pressure and/or temperature increases across the multi-stage compressor.

FIG. 1 is a block diagram of an exemplary embodiment of a fault detection and protection system 10 configured to detect faults at an early time based at least in part on inter-stage measurements throughout a gas turbine engine 12. In certain embodiments, the fault detection and protection system 10 includes a controller 14 configured to respond to detected faults at an early time to reduce the possibility of extensive damage and downtime of the gas turbine engine 12. The fault detection and protection system 10 may be used to sense faults at multiple locations (e.g., inlet, outlet, and inter-stage) throughout a multi-stage compressor 16 via a monitoring system 18. The fault detection and protection system 10 also may be used to sense faults at multiple locations (e.g., inlet, outlet, and inter-stage) throughout a multi-stage turbine 20 via a monitoring system 22. In certain embodiments, the monitoring systems 18 and 22 may be combined together as a single monitoring system. As discussed in detail below, the inter-stage measurements (e.g., pressure, temperature, acoustic, optical, flow rate, vibration, and so forth) enable the controller 14 to more rapidly identify faults in the compressor 16 and the turbine 20, thereby reducing the possibility of more extensive damage and downtime. This is particularly advantageous as the number of stages increases in the compressor 16 and the turbine 20. For example, the compressor 16 and the turbine 20 may each have a plurality of stages (e.g., 5, 10, 15, 20, 25, 30, or more stages). The monitoring systems 18 and 22 may include one or more sensors disposed at each stage. Although the following discussion relates primarily to the compressor 16 in context of the gas turbine engine 12, the disclosed embodiments may be used with any multi-stage system having rotary blades, e.g., a gas turbine, a steam turbine, a hydro turbine, a compressor driven by another source, and so forth.

In certain embodiments, the gas turbine engine 12 may mix compressed air with a liquid or gas fuel, such as natural gas and/or a hydrogen rich synthetic gas. As depicted, a plurality of fuel nozzles 24 intakes a fuel supply, mixes the fuel with air, and distributes the air-fuel mixture into a combustor 26. The air-fuel mixture combusts in a chamber within the combustor 26, thereby creating hot pressurized exhaust gases. The combustor 26 directs the exhaust gases through a turbine 20 toward an exhaust outlet 28. As the exhaust gases pass through the turbine 20, the gases force one or more turbine blades to rotate a shaft 30 along an axis 32 of the gas turbine engine 12. As illustrated, the shaft 30 is connected to various components of the gas turbine engine 12, including the multi-stage compressor 16. As described in greater detail below, the multi-stage compressor 16 may include multiple stages with multiple blades that may be coupled to the shaft 30. Thus, the multiple blades within the multi-stage compressor 16 rotate as the shaft 30 rotates, thereby compressing air from an air intake 34 through the multi-stage compressor 16 and into the fuel nozzles 24 and/or the combustor 26. The shaft 30 may also be connected to a load 36, which may be a vehicle or a stationary load, such as an electrical generator in a power plant or a propeller on an aircraft. The load 36 may include any suitable device configured to be powered by the rotational output of the gas turbine engine 12.

Figure 2:
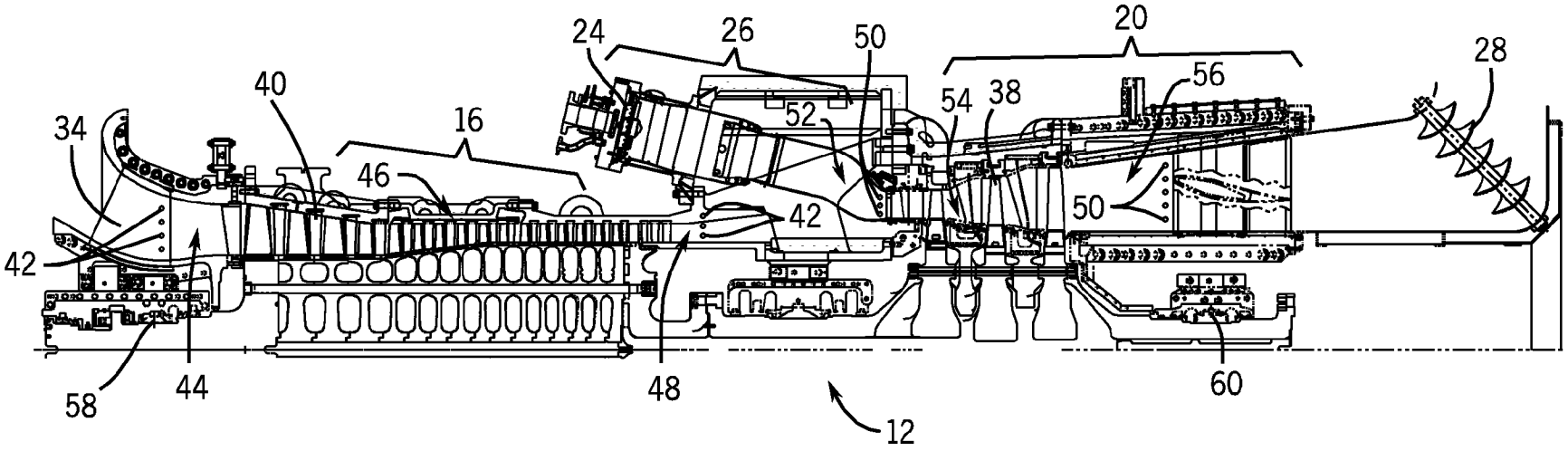
FIG. 2 is a cross sectional side view of the gas turbine engine of FIG. 1.

FIG. 2 is a cross sectional side view of the gas turbine engine 12 of FIG. 1. As illustrated, the gas turbine engine 12 includes one or more fuel nozzles 24 located inside one or more combustors 26. In operation, air enters the gas turbine engine 12 through the air intake 34 and may be pressurized in the multi-stage compressor 16. The compressed air may then be mixed with fuel for combustion within the combustor 26. For example, the fuel nozzles 24 may inject a fuel-air mixture into the combustor 26 in a suitable ratio for optimal combustion, emissions, fuel consumption, and power output. The combustion generates hot pressurized exhaust gases, which then drive one or more blade rows 38 within the turbine 20 to rotate the shaft 30 and, thus, the multi-stage compressor 16 and the load 36. The rotation of the shaft 30 also causes one or more blades 40 within the multi-stage compressor 16 to draw in and pressurize the air received by the intake 34.

In certain embodiments, the fault detection and protection system 10 of FIG. 1 is configured to measure one or more parameters at inlets, outlets, and inter-stage locations throughout the turbine engine 12, including inter-stage locations throughout the compressor 16 and inter-stage positions throughout the turbine 20. For example, the fault detection and protection system 10 may include one or more compressor sensors 42 disposed at a compressor inlet 44, a plurality of inter-stage compressor locations 46, and a compressor outlet 48, rather than merely including compressor sensors 42 at the inlet 44 and/or outlet 48. Thus, as discussed in further detail below, the compressor sensors 42 are configured to substantially improve the detection of faults in time and space, i.e., more rapid response time and more precise identification of the location of the fault. By further example, the fault detection and protection system 10 may include one or more turbine sensors 50 disposed at a turbine inlet 52, a plurality of inter-stage turbine locations 54, and a turbine outlet 56, rather than merely including turbine sensors 50 at the inlet 52 and/or outlet 56. Thus, as discussed in further detail below, the turbine sensors 50 are configured to substantially improve the detection of faults in time and space, i.e., more rapid response time and more precise identification of the location of the fault. As appreciated, the sensors 42 and 50 may include pressure sensors, temperature sensors, vibration sensors, acoustic sensors, optical sensors, or any combination thereof. These sensors 42 and 50 may be arranged at multiple locations about the circumference of the casing, multiple axial locations on both upstream and downstream sides of each stage, and so forth. The inter-stage sensors 42 and 50 are configured to drastically improve response time and reduce the possibility of extensive damage in the event of a fault, as compared to a system with no inter-stage sensors 42 and 50.

For example, as a comparison with the disclosed fault detection and protection system 10, fault monitoring would be particularly slow and space insensitive if sensors were located only at the compressor inlet 44 and the turbine outlet 56. Although these locations may be readily accessible for sensors, a significant amount of space would not be monitored without the sensors 42 and 50 between these inlet and outlet locations 44 and 56. In other words, if sensors were placed only at the inlet 44 and the outlet 56, then the changes would be averaged over the entire turbine engine 12, thereby making it difficult to identify a fault in either the compressor 16 or the turbine 20. A significant fault in one particular stage of the compressor 16 or the turbine 20 will cause a shift in temperature and/or pressure in that particular stage, yet the impact of this shift may be undetectable by sensors only at the inlet 44 and outlet 56. Likewise, if the compressor 16 is monitored only by sensors at the compressor inlet 44 and the compressor outlet 48, then the fault may not be readily detected due to a smaller perturbation of measurable exit conditions as compared to a more locally measurable impact. Furthermore, if the turbine 20 is monitored only by sensors at the turbine inlet 52 and the turbine outlet 56, then the fault may not be readily detected due to averaging over the multiple stages and/or compensatory control action as, for example, to maintain a selected output.

A common means of fault detection in rotating turbomachinery is vibration monitoring at the bearings 58, 60. This means relies on the fact that a rotating blade has been damaged or has failed, causing a rotor imbalance. If the failed component is a stationary blade, there will generally be no detectable imbalance unless the liberated part damages downstream rotating blades enough to cause a detectable imbalance. Similarly, if the machine is large enough, and the failed rotating blade small enough, the problem may still be undetectable by this means. Consequently, a small problem will generally have to grow larger to be detectable via bearing vibration (e.g., due to collateral damage to downstream parts) before the control or operator becomes aware that protective action is needed. In addition, if and when a fault is detected by this means, the diagnostic information available from the vibration signature may only provide crude guidance regarding the location of the fault and its progression history. In general, the foregoing measurements at limited locations (i.e., not inter-stage) do not adequately detect faults at an early stage, thereby reducing the ability to take corrective measures before significant damage occurs.

Again, the disclosed embodiments of the fault detection and protection system 10 increase the sensitivity of fault detection in time and space by utilizing sensors at one or more inter-stage locations of the compressor 16, the turbine 20, or a combination thereof. In the following discussion, the fault detection and protection system 10 is discussed in context of the compressor 16, but it should be appreciated that the fault detection and protection system 10 is equally applicable to the turbine 20 and other multi-stage systems. At various inter-stage locations 46 and 54, the sensors 42 and 50 may monitor pressure, temperature, vibration, acoustics, or a combination thereof. These measured parameters may be compared with other stages (i.e., upstream and/or downstream), the inlets 44 and 52, the outlets 48 and 56, or a combination thereof. For example, the disclosed embodiments may compare baseline ratios with real-time ratios to identify abnormalities indicative of a fault. The ratios may include an inter-stage parameter versus an inlet parameter, an inter-stage parameter versus an outlet parameter, a first inter-stage parameter versus a second inter-stage parameter, or a combination thereof. Again, the parameters may include temperature, pressure, vibration, acoustics, or a combination thereof.

Figure 3:
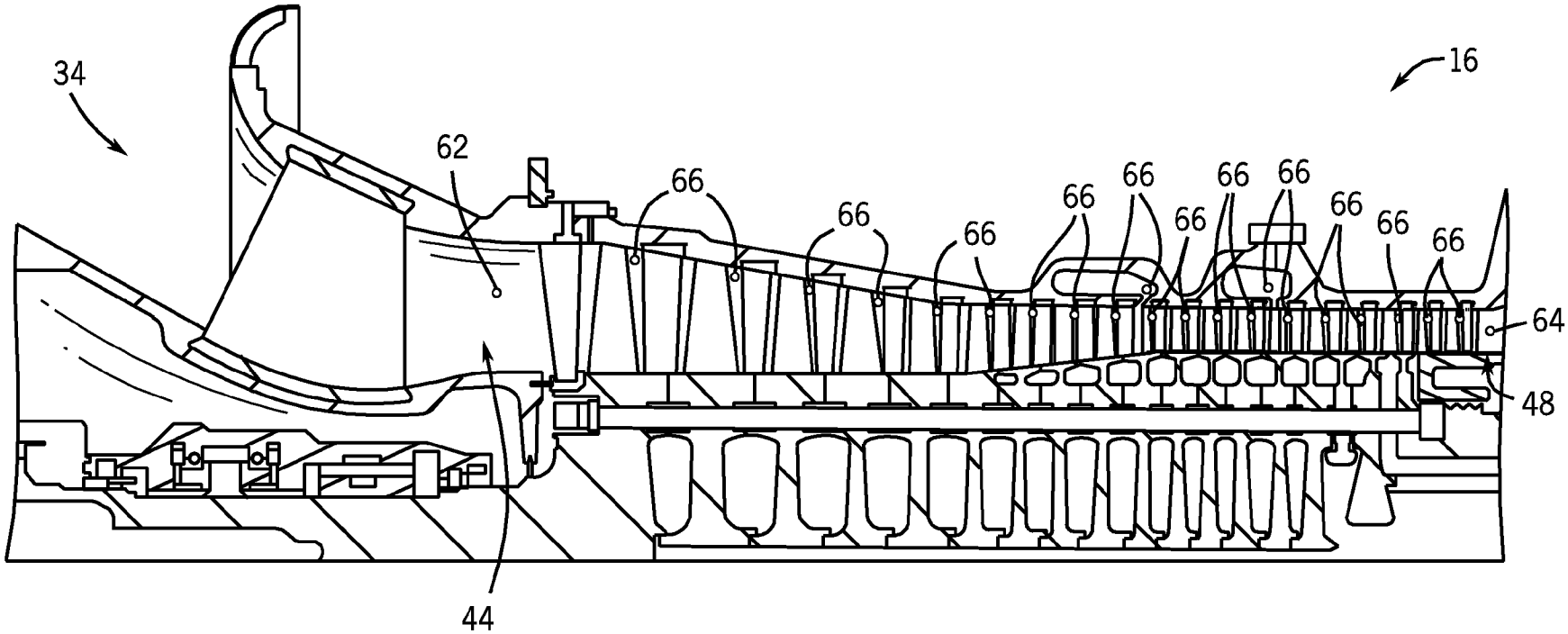
FIG. 3 is a cross sectional side view of an exemplary embodiment of the multi-stage compressor of the gas turbine engine of FIGS. 1 and 2, having multiple inter-stage sensors for identifying faults in the multi-stage compressor.

FIG. 3 is a cross sectional side view of an exemplary embodiment of the multi-stage compressor 16 of the gas turbine engine 12 of FIGS. 1 and 2. As illustrated, the multi-stage compressor 16 may include multiple sensors located along the length of the multi-stage compressor 16. In particular, the illustrated embodiment of the multi-stage compressor 16 includes an inlet sensor 62 proximate to the inlet 44 of the multi-stage compressor 16 and an outlet sensor 64 proximate to the outlet 48 of the multi-stage compressor 16. In addition, the multi-stage compressor 16 includes at least one inter-stage sensor 66 located between stages of the multi-stage compressor 16. The inter-stage sensors 66 may be arranged at multiple locations about the circumference of the casing, multiple axial locations on both upstream and downstream sides of each stage, and so forth. The exact number of inter-stage sensors 66 may vary between implementations. For example, in certain embodiments, the multi-stage compressor 16 may include one or more inter-stage sensors 66 between every stage of the multi-stage compressor 16. However, in other embodiments, some stages may not include inter-stage sensors 66. The number of inter-stage sensors 66 may depend upon conditions specific to the multi-stage compressor 16. For example, certain stages may not include suitable locations for placing sensors. In addition, at some point, cost constraints may limit the number of inter-stage sensors 66 used.

As described above, in certain embodiments, the inlet sensor 62, the outlet sensor 64, and the plurality of inter-stage sensors 66 may include pressure sensors, temperature sensors, vibrations sensors, acoustic sensors, optical sensors, flow rate sensors, and so forth. In the presence of a failure or other type of damage within a particular stage, both the pressure and temperature increase across the stage experiencing the damage may be drastically affected. Indeed, if the failure is severe enough, the pressure and temperature increases across the stage experiencing the failure may be reduced to zero or at least a negligible amount. For example, the pressure drop and temperature rise may change by at least greater than 10, 20, 30, 40, 50, 60, 70, 80, 90, or even 100% of an expected value. As such, monitoring inter-stage pressures and temperatures will enable detection of faults within the multi-stage compressor 16 more readily. In other words, while the change in overall performance of the multi-stage compressor 16 may not be readily detectable due to a failure in one or a few stages, the relative performance of each stage or group of stages will be more apparent and will provide a stronger indication of a component damage or failure.

Pressure and temperature measurements are not the only type of inter-stage measurements which may be used to detect faults within the multi-stage compressor 16. For example, in certain embodiments, acoustic sensors may be used for the inter-stage sensors 66. Faults may also be detected using sound signatures within each of the individual stages of the multi-stage compressor 16. In addition, in other embodiments, optical sensors may be used for the inter-stage sensors 66. Light variations detected by the optical sensors may indicate variations in the flow of the working fluid through the multi-stage compressor 16, which may be indicative of faults within the multi-stage compressor 16. Furthermore, any type of sensors (e.g., vibration sensors, flow rate sensors, and so forth) which may indicate faults within the multi-stage compressor 16 may be used.

Figure 4:
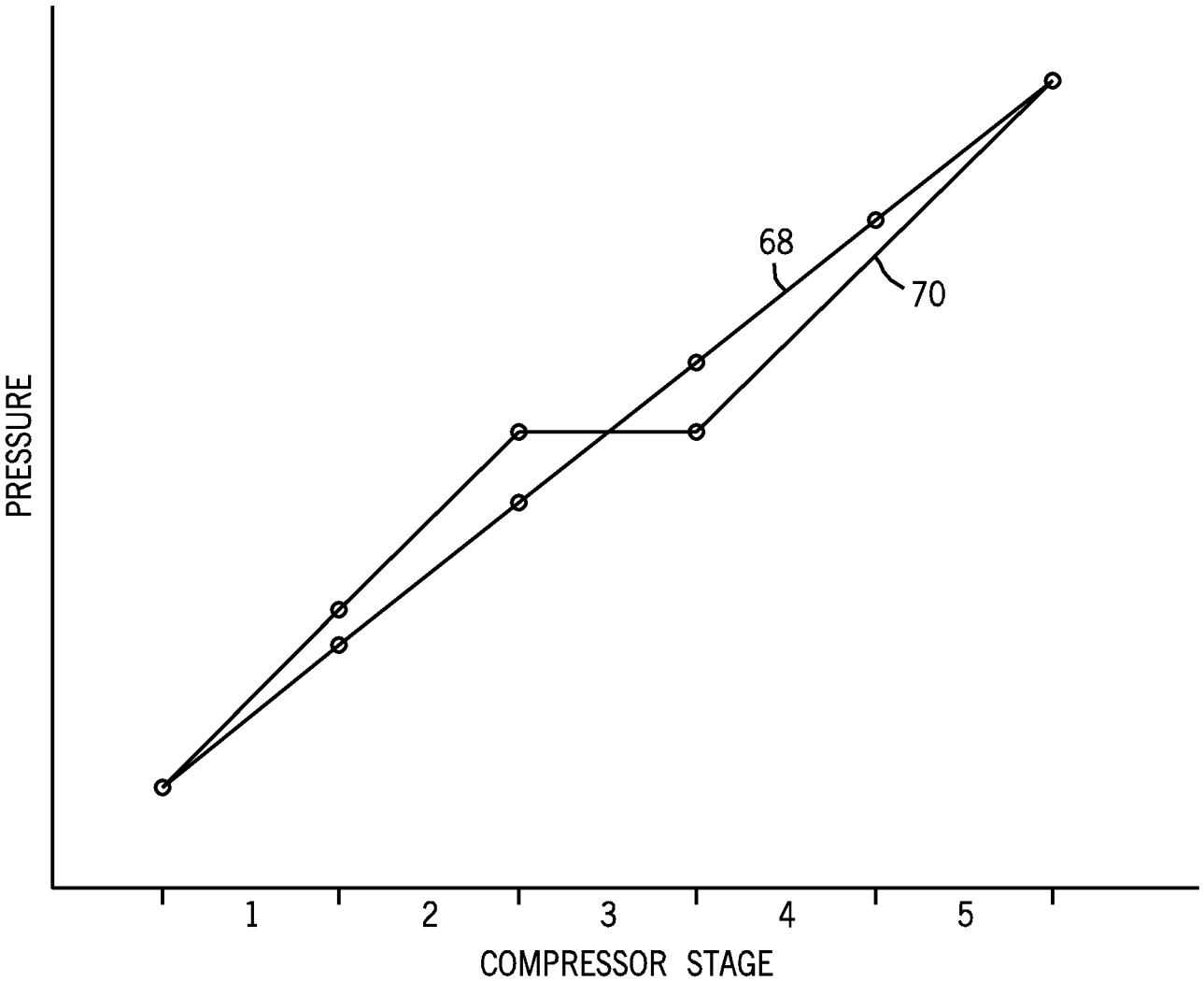
FIG. 4 is a graph of a pressure profile of an exemplary embodiment of the multi-stage compressor with five individual stages, both healthy and unhealthy.

FIG. 4 is a graph of a pressure profile of an exemplary embodiment of the multi-stage compressor 16 with five individual stages. The illustrated graph depicts a first pressure profile 68 during normal operation and a second pressure profile 70 during a failure within the third stage of the multi-stage compressor 16. As illustrated, under normal conditions, the first pressure profile 68 may be such that the pressure increase across each individual stage is relatively constant. However, it should be noted that this healthy pressure rise profile will be machine-specific. For example, under normal operating conditions, certain individual stages may contribute greater pressure increases than others. Regardless, the total pressure increase across the multi-stage compressor 16 may equal the summation of pressure increases across the five illustrated stages.

As illustrated, in the scenario where there has been a failure within the third stage of the multi-stage compressor 16, the pressure increase across the third stage of the multi-stage compressor 16 may be drastically reduced. To a certain degree, the other four stages may compensate for the loss in pressure across the third stage. For instance, the pressure increase across the first and second stages is illustrated as increasing from the first pressure profile 68 (e.g., normal operation) to the second pressure profile 70 (failure within the third stage). In addition, the pressure increase across the fourth and fifth stages is also illustrated as increasing from the first pressure profile 68 (e.g., normal operation) to the second pressure profile 70 (failure within the third stage).

In certain embodiments, the pressure increase across each stage of the multi-stage compressor 16 may be compared to the overall pressure increase across the multi-stage compressor 16. For example, assume that under normal conditions of the multi-stage compressor 16 depicted in FIG. 4 (the first pressure profile 68), each individual stage of the multi-stage compressor 16 contributes exactly the same amount of pressure increase. Under these normal conditions, each individual stage contributes 20% of the total pressure increase of the multi-stage compressor 16. However, as illustrated in FIG. 4, assume that during the scenario where the third stage experiences component failure or damage (the second pressure profile 70), the pressure increase across the third stage has been reduced to zero while the other four stages perfectly compensate for the decrease in pressure increase across the third stage. Under this failure scenario, the third stage contributes 0% of the total pressure increase of the multi-stage compressor 16 while the other four stages each contribute 25% of the total pressure increase of the multi-stage compressor 16. Monitoring these changes in pressure increase across each of the individual stages of the multi-stage compressor 16 will enable quicker detection of the component failure or damage and more precise localization of the failure, in this example the third stage of the multi-stage compressor 16. For instance, the component damage or failure may be located within a particular stage or at least a small number of stages. Note also that in this example, as is typical in a real machine, the compressor exit pressure was generally unaffected by the fault and would thus by itself, or in combination with the inlet pressure, not provide a fault indication.

In addition to comparing the pressure increase across each stage of the multi-stage compressor 16 to the overall pressure increase across the multi-stage compressor 16, the pressure increase across each stage of the multi-stage compressor 16 may be compared to the pressure increase across itself during normal operations or may be compared to the pressure increase of other stages of the multi-stage compressor 16. This approach may magnify a measured change, making a component failure or damage more readily detectable. For example, as illustrated in FIG. 4, the third stage of the multi-stage compressor 16 may contribute 20% of the total pressure increase of the multi-stage compressor 16 during normal conditions (the first pressure profile 68). However, during a component failure or damage within the third stage (the second pressure profile 70), the third stage may contribute 0% of the total pressure increase of the multi-stage compressor 16. Therefore, the contribution of the third stage during a component failure or damage of the third stage may decrease by 100% in the illustrated example. Conversely, as illustrated in FIG. 4, the other four stages of the multi-stage compressor 16 may also contribute 20% of the total pressure increase of the multi-stage compressor 16 during normal conditions (the first pressure profile 68). However, during a component failure or damage within the third stage (the second pressure profile 70), the other four stages may contribute 25% of the total pressure increase of the multi-stage compressor 16. Therefore, the contribution of the other four stages during a component failure or damage of the third stage may increase by 25% (e.g., (25%-20%) divided by 20%) in the illustrated example.

In addition to measuring and monitoring pressure increases across individual stages of the multi-stage compressor 16, pressure increases across other sections of the multi-stage compressor 16 may also be measured and monitored. A section may include multiple individual stages of the multi-stage compressor 16. For example, in the example depicted in FIG. 4, a first section of the multi-stage compressor 16 may include the first, second, and third stages of the multi-stage compressor 16 whereas a second section of the multi-stage compressor 16 may include the fourth and fifth stages of the multi-stage compressor 16. Indeed, any combination of stages may be used as sections for detecting faults within the multi-stage compressor 16.

As described above, the first pressure profile 68 depicted in FIG. 4 represents normal operating conditions of the multi-stage compressor 16. The first pressure profile 68 may be determined using any appropriate representation of the performance of the multi-stage compressor 16 across its multiple stages. For example, in certain embodiments, the expected pressure profile for the multi-stage compressor 16 may be determined based on historical performance of the multi-stage compressor 16. In other embodiments, the expected pressure profile for the multi-stage compressor 16 may be determined using predictive models. In still other embodiments, the expected pressure profile for the multi-stage compressor 16 may incorporate combinations of historical performance, predictive models, and any other empirical or calculated methods related to either the particular multi-stage compressor 16 being used or another comparable multi-stage compressor 16. Furthermore, the expected pressure profile for the multi-stage compressor 16 may be a function of any relevant operating condition of the multi-stage compressor 16 which would normally be expected to impact performance. For example, in certain embodiments, the expected pressure profile may be a function of shaft speed, guide vane position, inlet conditions, outlet conditions, and so forth. Regardless, the expected pressure profile may be referred to as a baseline against which inter-stage parameters (e.g., sensed by the inter-stage sensors 66) may be compared.

Once it has been determined that the pressure increase ratio for a particular stage or section of stages has deviated (e.g., increased or decreased) from the expected pressure increase ratio for the stage or section of stages by more than a predetermined amount, an appropriate control response may be initiated. For example, under certain circumstances, an appropriate control response may be to alert an operator of the multi-stage compressor 16 that a pressure increase ratio has deviated from the expected pressure increase ratio by the predetermined amount. For example, the operator may be alerted when the deviation from the expected pressure increase ratio is only by a small amount or has only occurred for a short period of time. The alert may include an audio alert (e.g., beeping noise), vibration, light (e.g., from a light emitting diode), display message (e.g., on a display screen), email message, text message, and so forth. However, once the deviation from the expected pressure increase ratio either reaches a larger value or continues to occur for a longer period of time, operating parameters of the multi-stage compressor 16 may be automatically adjusted. For example, under certain circumstances, the multi-stage compressor 16 may be shut down in response to deviation from the expected pressure increase ratio.

As the number of stages within the multi-stage compressor 16 increases, the sensitivity of the fault detection using comparisons of pressure increase ratios may decrease somewhat. For example, although illustrated in FIG. 4 as having only five stages, the multi-stage compressor 16 may include many more stages. For example, in certain embodiments, the multi-stage compressor 16 may include 10, 11, 12, 13, 14, 15, 16, 17, 18, 19, 20, 21, 22, 23, 24, 25, 26, 27, 28, 29, 30, or even more stages. In the example depicted in FIG. 4, each individual stage contributes approximately 20% of the total pressure increase of the multi-stage compressor 16 during normal operations (e.g., the first pressure profile 68). However, for example, in a multi-stage compressor 16 having 30 stages, the pressure increase contribution of each individual stage may only be on the order of 3% of the total pressure increase of the multi-stage compressor 16 during normal operations (e.g., the first pressure profile 68). In addition, the example depicted in FIG. 4 assumes that during a component failure or damage within the third stage (e.g., the second pressure profile 70), the pressure increase across the third stage is reduced to zero or at least a negligible amount. However, in actuality, even when a component fails or is damaged within a stage of the multi-stage compressor 16, the affected stage may actually still be able to generate a certain amount of pressure increase. For both of these reasons, in a multi-stage compressor 16 having a greater number of stages, the ability to detect faults within the multi-stage compressor 16 using comparisons of pressure increase ratios will depend on the extent and sensitivity of the monitoring.

Figure 5:
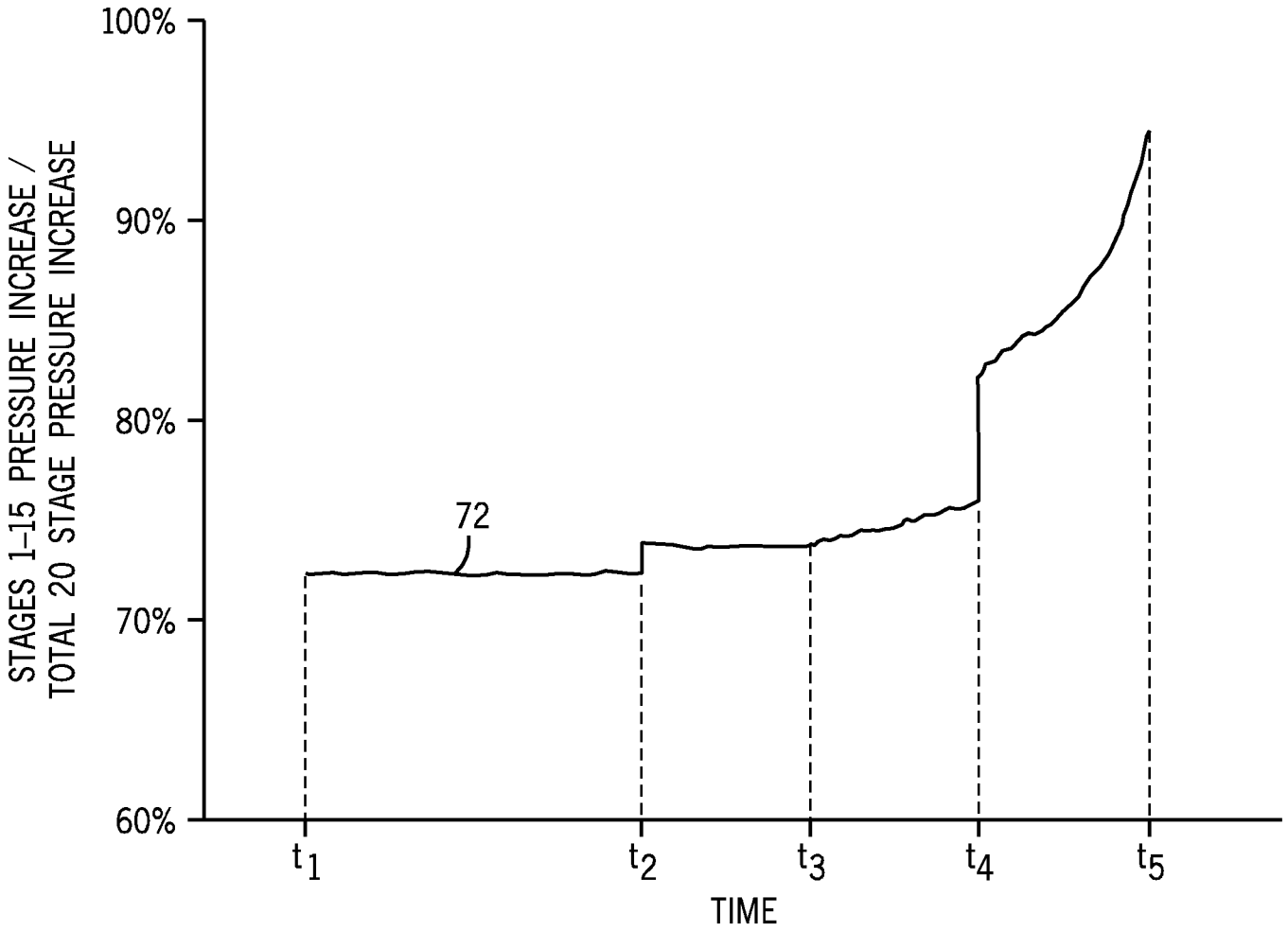
FIG. 5 is a graph of the percentage pressure increase of the first fifteen stages of an exemplary 20-stage compressor compared to the total pressure increase of the exemplary 20-stage compressor, in its original healthy condition and as it degrades due to compressor hardware failure.

For example, FIG. 5 is a graph of the percentage pressure increase of the first fifteen stages of an exemplary 20-stage compressor 16 compared to the total pressure increase of the exemplary 20-stage compressor 16. The 20-stage compressor 16 is merely intended to be an exemplary embodiment of the multi-stage compressor 16 to illustrate the degree of sensitivity used to detect faults within the multi-stage compressor 16. As illustrated, the pressure increase ratio 72 (e.g., the pressure increase across the first fifteen stages compared to the total pressure increase of the exemplary 20-stage compressor 16) may experience four distinct phases of operation during a failure of one of the stages of the exemplary 20-stage compressor 16. For example, at time $t_1$, the exemplary 20-stage compressor 16 may have reached a steady-state condition (e.g., before any faults and with no apparent issues). As illustrated, the pressure increase ratio 72 may have reached a somewhat steady-state value of approximately 74%. However, at time $t_2$, an initial deviation of the pressure increase ratio 72 may be detected. As illustrated, the pressure increase ratio 72 may reach a new steady-state level and the increase may only be on the order of 1% (e.g., from approximately 74% to approximately 75%). However, such a sharp increase from the previous steady-state level may indicate that a fault has occurred within the exemplary 20-stage compressor 16. More specifically, the fact that the contribution of pressure increase has increased for stages 1-15 may indicate that a fault has occurred downstream of stages 1-15 (e.g., stages 16-20). Next, at time $t_3$, progressive deterioration of the pressure increase ratio 72 may be experienced (e.g., gradual increase from approximately 75% to approximately 76%). Then, at time $t_4$, the final stage of deterioration may result in sudden increases (e.g., from approximately 76% to approximately 83%) and steep progression toward nearly 100% at time $t_5$. It is this final deterioration period where most of the excessive damage to the exemplary 20-stage compressor 16 may occur.

Therefore, as depicted in FIG. 5, the ability to detect the first few phases of deterioration (e.g., between time $t_2$ and time $t_4$) is important to detect faults in substantially real-time or in rapid response once they occur, before the damage becomes excessive (e.g., after $t_4$). In certain embodiments, detecting faults in substantially real-time may include detecting faults within a time period of less than 10, 20, 30, 40, 50, or 60 seconds. In certain embodiments, detecting faults in rapid response may include detecting faults within a time period of less than 5, 10, 15, or 20 minutes. The amount of time within which faults may be detected may depend upon operating conditions of the specific multi-stage compressor 16 and the component failure mode. For example, as illustrated in FIG. 5, when the multi-stage compressor 16 includes a greater number of stages, the amount of detectable increase in the pressure increase ratio 72 may be relatively small. Therefore, the time for detecting faults may be longer than if the multi-stage compressor 16 included fewer stages or was more heavily monitored.

Figure 6:
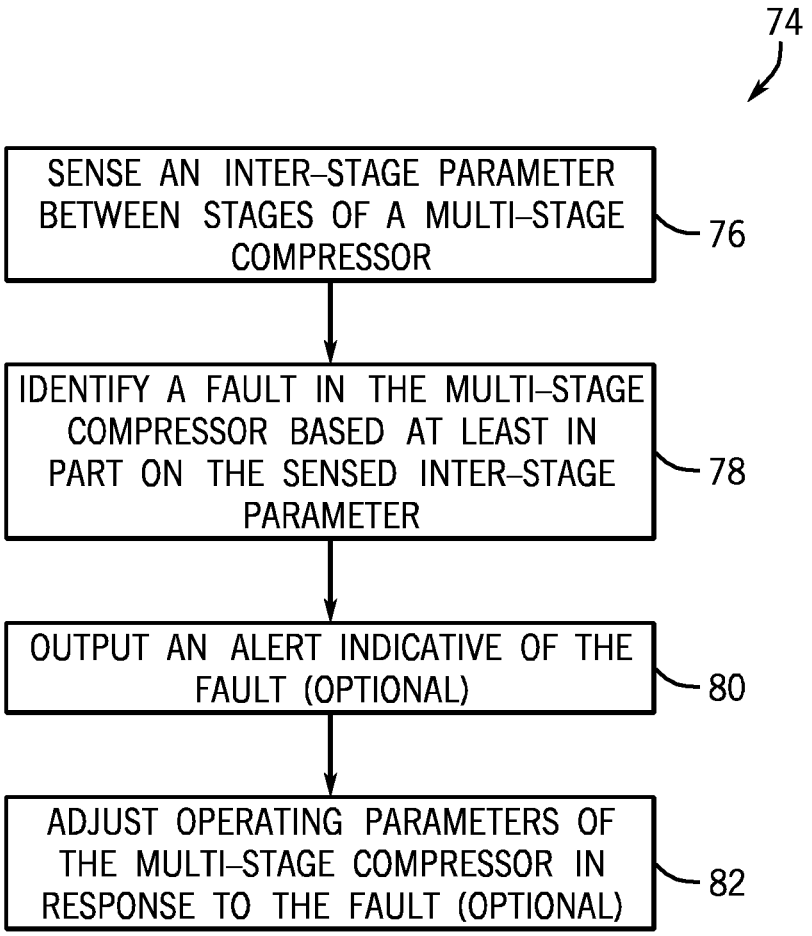
FIG. 6 is an exemplary embodiment of a method for identifying faults in the multi-stage compressor using inter-stage pressure increase ratios.

FIG. 6 is an exemplary embodiment of a method 74 for identifying faults in the multi-stage compressor 16 using inter-stage pressure increase ratios. At step 76, at least one inter-stage parameter may be sensed between stages of the multi-stage compressor 16. As discussed above, the sensed inter-stage parameter may be any parameters suitable for identifying faults within the multi-stage compressor 16. For example, in certain embodiments, the sensed inter-stage parameter may be an inter-stage pressure or, more particularly, an inter-stage pressure increase which is sensed via inter-stage pressure sensors. In other embodiments, the sensed inter-stage parameter may be an inter-stage temperature or, more particularly, an inter-stage temperature increase which is sensed via inter-stage temperature sensors. In addition, other types of inter-stage sensors may be utilized. For example, inter-stage acoustic sensors may be used to sense acoustic parameters which may indicate faults within the multi-stage compressor 16. In addition, inter-stage optical sensors may be used to sense optical parameters which may also indicate faults within the multi-stage compressor 16. Furthermore, any type of inter-stage sensors (e.g., vibration sensors, flow rate sensors, and so forth) which may indicate faults within the multi-stage compressor 16 may be used.

At step 78, a fault in the multi-stage compressor 16 may be identified based at least in part on the sensed inter-stage parameter. The identified fault may include several different types of issues within the multi-stage compressor 16. For example, the fault may include an actual failure (e.g., a breakage or other physical and/or structural fault) of one of the components within the multi-stage compressor 16. However, the fault may also include other types of damage (e.g., blade unbalance and erosion, unacceptable friction due to changes in clearance, and so forth). As discussed above, the identification of the fault may include comparison of the sensed inter-stage parameter against predicted values (e.g., generated by a predictive model), historical values (e.g., prior operating data of the same multi-stage compressor 16 or another comparable multi-stage compressor 16), or a combination thereof.

At step 80, once the fault has been identified, an alert indicative of the fault may optionally be output. For example, the alert may include an audio alert (e.g., beeping noise), vibration, light (e.g., from a light emitting diode), display message (e.g., on a display screen), email message, text message, and so forth. In addition, at step 82, once the fault has been identified, operating parameters of the multi-stage compressor 16 may be optionally adjusted in response to the fault. In certain situations, the adjustment of the operating parameters of the multi-stage compressor 16 may be performed automatically in response to the fault. However, in other situations, the adjustment of the operating parameters of the multi-stage compressor 16 may be performed manually by an operator of the multi-stage compressor 16.

The adjustment of the operating parameters of the multi-stage compressor 16 may also vary between minimal adjustment (e.g., reducing the operating speed or load of the multi-stage compressor 16) to more drastic adjustment (e.g., shutting down the multi-stage compressor 16). The amount of adjustment performed may, for instance, depend upon the degree of deviation of the inter-stage parameter from an expected value. For example, if the deviation of the sensed inter-stage parameter from the expected value is greater than a first, lower threshold value but less than a second, higher threshold value, the operating speed or load of the multi-stage compressor 16 may be reduced. However, if the deviation of the sensed inter-stage parameter from the expected value is greater than both the first, lower threshold value and the second, higher threshold value, the multi-stage compressor 16 may be completely shut down.

In addition, in certain embodiments, there may be a time delay between identifying the fault and either outputting alerts or adjusting operating parameters of the multi-stage compressor 16. For example, in certain embodiments, a time delay of 5, 10, 15, or 20 minutes may be used in order to confirm that the deviations in the sensed inter-stage parameter which identified the fault were not merely statistical aberrations. In other embodiments, no time delay may be used. Not using a time delay may prove beneficial for enabling an appropriate response in substantially real-time. In addition to time delays, in certain embodiments, multiple alerts may be outputted before operating parameters of the multi-stage compressor 16 are adjusted. Outputting multiple alerts may allow further analysis to be performed before operating parameters of the multi-stage compressor 16 are adjusted, either automatically or manually.

Technical effects of the disclosed embodiments include providing systems and methods for identifying faults within the multi-stage compressor 16 using pressure increase ratios, which may be determined from inter-stage parameters sensed between stages of the multi-stage compressor 16. In certain embodiments, the method 74 illustrated in FIG. 6 may be performed by the controller 14 configured to obtain (e.g., receive) the sensed inter-stage parameters, to identify faults within the multi-stage compressor 16 based at least in part on the sensed inter-stage parameters, to output alerts indicative of the faults, and to adjust operating parameters of the multi-stage compressor 16 in response to the faults. The controller 14 may, in certain embodiments, be a physical computing device specifically configured to obtain (e.g., receive) the sensed inter-stage parameters, to identify faults within the multi-stage compressor 16 based at least in part on the sensed inter-stage parameters, to output alerts indicative of the faults, and to adjust operating parameters of the multi-stage compressor 16 in response to the faults. More specifically, the controller 14 may include input/output (I/O) devices for receiving the sensed inter-stage parameters, for outputting the alerts, and for transmitting signals to adjust the operating parameters of the multi-stage compressor 16. In addition, the controller 14 may include a memory device and a machine-readable medium with instructions encoded thereon for identifying faults based at least in part on the sensed inter-stage parameters. For example, the instructions may include machine-readable code for comparing the sensed inter-stage parameters against predicted values, historical values, or a combination thereof. As such, the controller 14 may also include a storage medium for storing historical data, and so forth.

The embodiments disclosed herein provide for instrumentation of the individual stages of the multi-stage compressor 16 and an associated control strategy for detecting anomalous behavior in the multi-stage compressor 16 at or near the onset of a problem, such that the controller 14 may issue an alarm and/or adjust operating parameters of the multi-stage compressor 16 prior to excessive damage to the multi-stage compressor 16. The disclosed embodiments take advantage of the fact that when a stage of the multi-stage compressor 16 experiences damage, the performance of the stage decreases. The performance decrease may be manifested as a shift in the compression duty from the damaged stage to the other undamaged stages. This shift may be detected in the pressure distribution within the multi-stage compressor 16. Using pressure increase ratios for fault detection may facilitate more refined degradation assessment for the multi-stage compressor 16, thereby reducing the cost and downtime associated with unwanted damage to the multi-stage compressor 16. The systems and methods disclosed herein may be applied to new gas turbine engines 12 or may be retrofitable as enhancements to the instrumentation and control systems of existing gas turbine engines 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

an inter-stage sensor configured to sense a steady-state parameter at an inter-stage location between a plurality of stages of rotary blades of a rotary machine; and a controller programmed to identify a hardware fault in the rotary machine based at least in part on the sensed inter-stage steady-state parameter, wherein the controller is programmed to compare a baseline ratio to a real-time ratio of the steady-state parameter at the inter-stage location versus a different measurement location.

2. The system of claim 1, wherein the inter-stage sensor comprises a pressure sensor configured to obtain an inter-stage pressure measurement as the steady-state parameter, and the controller is programmed to identify an abnormal change in pressure associated with at least one stage of the rotary machine to identify actual damage or breakage in the rotary machine.

3. The system of claim 1, wherein the controller is programmed to compare the steady-state parameter against a predicted value, or a historical value, or a combination thereof.

4. The system of claim 1, wherein the steady-state parameter comprises pressure, temperature, vibration, acoustics, or a combination thereof, and the different measurement location comprises an inlet location, an outlet location, or a different inter-stage measurement location.

5. The system of claim 1, comprising the rotary machine, wherein the rotary machine comprises a compressor, a turbine, or a combination thereof, having the plurality of rotary blades.

6. The system of claim 1, wherein the controller is programmed to output an alert indicative of the hardware fault.

7. The system of claim 1, wherein the controller is programmed to adjust a speed, load, or working fluid flow of the rotary machine in response to the hardware fault.

8. The system of claim 7, wherein the controller is programmed to automatically shut down the rotary machine in response to the hardware fault.

9. The system of claim 1, comprising a turbine engine having a plurality of the inter-stage sensors disposed at inter-stage locations between the plurality of stages of rotary blades of a compressor.

10. A system, comprising:

an inter-stage sensor configured to sense a steady-state parameter at an inter-stage location between a plurality of stages of rotary blades of a rotary machine; and a controller programmed to identify a hardware fault in the rotary machine based at least in part on the sensed inter-stage steady-state parameter, wherein the controller is programmed to adjust a speed, load, or working fluid flow of the rotary machine in response to the hardware fault, and the controller is programmed to automatically shut down the rotary machine in response to the hardware fault.

11. The system of claim 10, wherein the inter-stage sensor comprises a pressure sensor configured to obtain an inter-stage pressure measurement as the steady-state parameter, and the controller is programmed to identify an abnormal change in pressure associated with at least one stage of the rotary machine to identify actual damage or breakage in the rotary machine.

12. The system of claim 10, wherein the controller is programmed to compare the steady-state parameter against a predicted value, or a historical value, or a combination thereof.

13. The system of claim 10, wherein the controller is programmed to compare a baseline ratio to a real-time ratio of the steady-state parameter at the inter-stage location versus a different measurement location.

14. The system of claim 13, wherein the steady-state parameter comprises pressure, temperature, vibration, acoustics, or a combination thereof, and the different measurement location comprises an inlet location, an outlet location, or a different inter-stage measurement location.

15. The system of claim 10, comprising the rotary machine, wherein the rotary machine comprises a compressor, a turbine, or a combination thereof, having the plurality of rotary blades.

16. The system of claim 10, wherein the controller is programmed to output an alert indicative of the hardware fault.

17. The system of claim 10, comprising a turbine engine having a plurality of the inter-stage sensors disposed at inter-stage locations between the plurality of stages of rotary blades of a compressor.

* * * * *